US011337565B1

(12) United States Patent
Maurer

(10) Patent No.: US 11,337,565 B1
(45) Date of Patent: May 24, 2022

(54) MARKING DEVICE

(71) Applicant: Philipp Maurer, McLean, VA (US)

(72) Inventor: Philipp Maurer, McLean, VA (US)

( * ) Notice: Subject to any disclaimer, the term of this patent is extended or adjusted under 35 U.S.C. 154(b) by 0 days.

(21) Appl. No.: 17/534,967

(22) Filed: Nov. 24, 2021

(51) Int. Cl.
*A47K 10/02* (2006.01)
*G09F 3/18* (2006.01)
*G09F 3/16* (2006.01)

(52) U.S. Cl.
CPC ..... *A47K 10/02* (2013.01); *G09F 3/16* (2013.01); *G09F 3/18* (2013.01)

(58) Field of Classification Search
CPC ..... A47K 10/02; A47K 10/14
See application file for complete search history.

(56) References Cited

U.S. PATENT DOCUMENTS 1,863,472 A * 6/1932 Covitch ..... G09F 3/16 40/652
3,462,809 A * 8/1969 Monroe, Jr. ..... A44B 99/00 24/562
3,507,085 A * 4/1970 Kruschwitz ..... B60J 10/33 52/204.597
3,787,922 A * 1/1974 Foy ..... A47B 95/00 16/404
3,962,758 A * 6/1976 Knappe ..... D06F 89/026 24/562
4,866,868 A * 9/1989 Kass ..... G09F 3/204 40/661
5,495,644 A * 3/1996 Mesher ..... B42D 15/045 24/3.12
6,082,687 A * 7/2000 Kump ..... G09F 17/00 248/224.51
D566,539 S * 4/2008 Hicks ..... D8/395
7,887,916 B2 2/2011 Chamandy
8,061,070 B2 * 11/2011 Chamandy ..... G09F 3/20 40/658
D757,533 S * 5/2016 Ormsbee ..... D8/395
10,699,603 B2 * 6/2020 Deco ..... G09F 3/06
D889,511 S * 7/2020 O'Hare ..... D15/5
2003/0056344 A1 * 3/2003 Brogdon, III ..... A47K 10/14 24/564
2003/0154579 A1 * 8/2003 Disher ..... B43M 99/001 24/462
2008/0289159 A1 * 11/2008 Solich ..... D06F 55/00 24/571

(Continued)

FOREIGN PATENT DOCUMENTS

WO 9830621 A1 7/1998

OTHER PUBLICATIONS

Screen Shot of Third Party Device ("Towel Tag") for Sale From Towel Tag (Sault Ste Marie, Ontario, Canada); retrieved from www.toweltag.com at least as early as Jan. 22, 2022.

(Continued)

*Primary Examiner* — Gary C Hoge
(74) *Attorney, Agent, or Firm* — Rucore IP

(57) ABSTRACT

A selectively attachable marking device for permitting a user to distinguish between multiple articles which otherwise look the same or similar, particularly textile articles such as bath linens, bed linens, or table linens. The device has a clip-like structure, and may be preferably provided with retaining ribs to resist undesired slippage of the device off an edge of the textile article with which it is used.

20 Claims, 13 Drawing Sheets

(56) References Cited

U.S. PATENT DOCUMENTS

| | | | | |
|---|---|---|---|---|
| 2014/0305014 | A1 | 10/2014 | Nunna et al. | |
| 2017/0303614 | A1* | 10/2017 | McMahon | A47K 10/14 |

OTHER PUBLICATIONS

Screen Shot of Third Party Device ("Towel Tag ID") for Sale From Towel Tag LLC (Lake Worth, FL); retrieved from www.toweltagid.com at least as early as Jan. 22, 2022.
Screen Shot of Third Party Device ("The Original Towel Tag") for Sale From FocalRation (Cold Spring, MN); retrieved from www.toweltag.com at least as early as Jan. 22, 2022.

* cited by examiner

MARKING DEVICE

FIELD OF THE INVENTION

The present invention relates to devices for clearly and distinctly marking, identifying and/or distinguishing between textile articles, particularly, but not only, between similar or identical looking articles.

BACKGROUND OF THE INVENTION

People frequently encounter textile articles such as, for example and without limitation, bath linens (such as, without limitation, bath towels and wash cloths), bed linens (such as, without limitation, bed sheets, pillow cases, and sometimes certain blankets), or table linens (such as, without limitation, napkins and tablecloths), which are often indistinguishable from one other on the one hand, and which, depending on the type of article, are preferably not to be interchanged between users (e.g., for sanitary or other hygienic reasons) on the other.

In an illustrative practical example, a family staying at a hotel or motel or the like is customarily supplied with multiple towels and washcloths, usually identical in general visual appearance. Even if new towels are supplied daily, during the course of a single day family members will have need of towels several times (for bathing, handwashing, pool visits, beach visits, etc.). Whether as a function of personal preference and/or for a variety of health/sanitary reasons, each family member will likely want to only use the same towel(s) and will want to avoid inadvertently using someone else's towel(s).

However, it is practically difficult to keep track of which towel "belongs" to which family member, in no small part because the towels of a given size are usually identical in appearance. This problem is made even more difficult because new towels are frequently no longer provided every day (e.g., ostensibly to reduce environmental costs by reducing the amount of laundry required). This means towels have to be kept sorted among family members even longer.

Even when towels are not similar in appearance to each other, the selection of available towels may still be unfamiliar (such as when visiting someone else's home), or the towels being used are used relatively infrequently (for example, beach towels). Thus, it can still be difficult to distinguish between towels.

Also, even when confusion between similar looking towels or the like is not a principal issue, it can also be a challenge to track how long a towel or the like has been used, for example, before it is preferably or otherwise desirably laundered or otherwise disinfected. For example, in a different illustrative situation, bath linens may be regularly distributed to residents in, for example, an assisted living facility or the like. It can therefore be practically challenging to track which resident has received which linens and how long ago (for example, to track a regular retrieval and laundry cycle). This logistical problem can be further exacerbated when the linens are very similar or identical.

SUMMARY OF THE INVENTION

The present invention relates to an easy-to-use physical device for marking, distinguishing, and/or identifying textile articles without permanently damaging the underlying article (or otherwise causing undue wear thereto), or hindering ordinary use of the article.

The marking device of the present invention generally slides onto or clips over an edge of a given textile article and, preferably, occupies or otherwise covers a relatively small portion of an overall area of the article in order to minimally interfere (if at all) with the overall utility of the article (such as a bath towel). The device may additionally have a structural configuration that decreases the possibility of the device becoming accidentally disengaged from an underlying textile article.

Most generally, the marking device comprises opposing and spaced apart first and second wall portions, each having correspondingly aligned first and second ends (which, in practice, can for example be referred to as proximal and distal edges), and a base portion extending between the respective proximal edges of the first and second wall portions so as to join the first and second wall portions together in the opposed and spaced apart configuration. In particular, the respective distal edges of the first and second wall portions are spaced apart from one other in order to allow an edge portion of a textile article to be passed/received therebetween.

In a preferred embodiment, the device includes a first retaining rib provided on an intermediate part of the inward face of each of the first and second wall portions, wherein the respective first retaining ribs protrude, respectively, from the inward face of the first wall portion towards the second wall portion, and from the inward face of the second wall portion towards the first wall portion. Each of the first retaining ribs extend laterally along a direction generally parallel to the base portion of the device (i.e. transverse to a proximal-to-distal direction of the device).

The device preferably further includes pluralities of second retaining ribs on the respective inward faces of the first and second wall portions, distal to the respective first retaining ribs on the inward faces of the first and second wall portions. The second retaining ribs also extend laterally along a direction generally parallel to the base portion of the device.

In an example of the present invention, respective proximal portions of the inward faces of the first and second wall portions are not provided with retaining ribs, such that a catch channel, proximal to the first and second retaining ribs, is at least partly defined by the rib-free inward faces of the first and second wall portions and the base portion, as will be explained in further detail below. The catch channel is particularly suited to receive and/or retain a thickened hem edge of certain textile articles when present (particularly, towels and the like), as is known in the textile arts.

BRIEF DESCRIPTION OF THE DRAWINGS

The present invention will be even more clearly understood when the written description of the invention herein is taken in conjunction with the drawings appended hereto, wherein.

Figure 1:
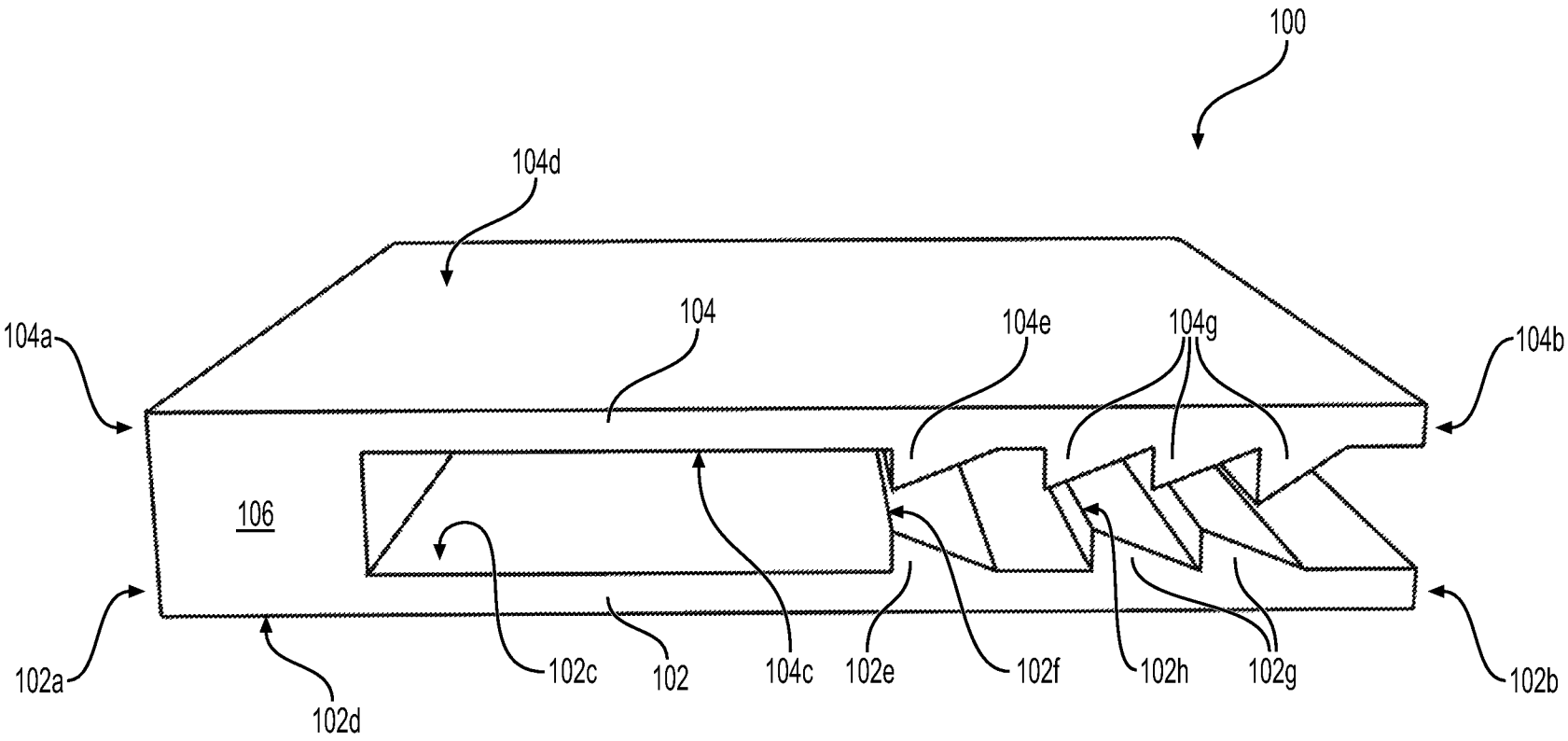
FIG. 1 is reverse left side perspective view of a first embodiment of the present invention.

It is noted that the respective drawings may or may not be of comparable scale to each other. The same reference numerals used across different figures represent the same features as described in the written description, but not all reference numerals are necessarily rigorously repeated in all of the figures (e.g., in order to retain visual clarity in the drawings and/or to reduce repetition).

DETAILED DESCRIPTION OF THE INVENTION

It is to be understood that details of the various aspects of the present invention disclosed herein, including, without limitation, descriptions of structure, materials and methods of manufacture, and modes of use, are specifically meant to be applicable to the broad concepts of the present invention in various combinations to the fullest extent possible, even in the absence of express linking language herein.

Figure 2:
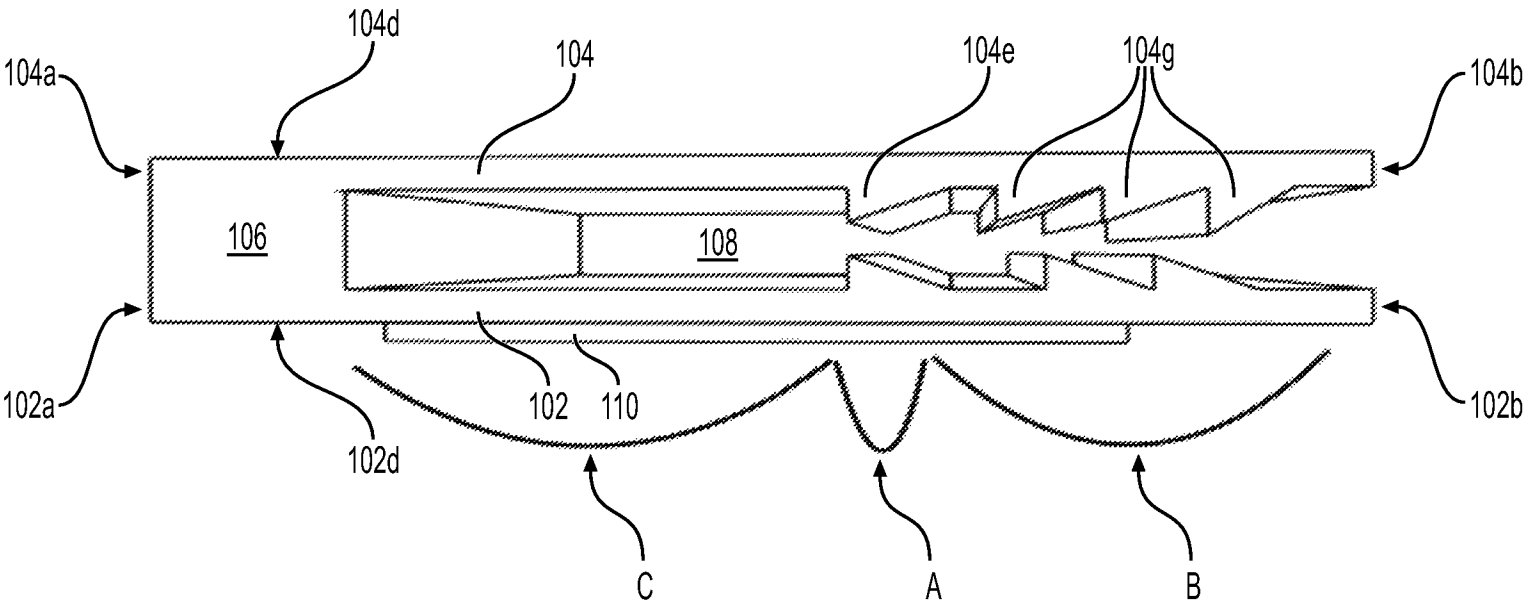
FIG. 2 is left side view of the device seen in FIG. 1.
Figure 3A:
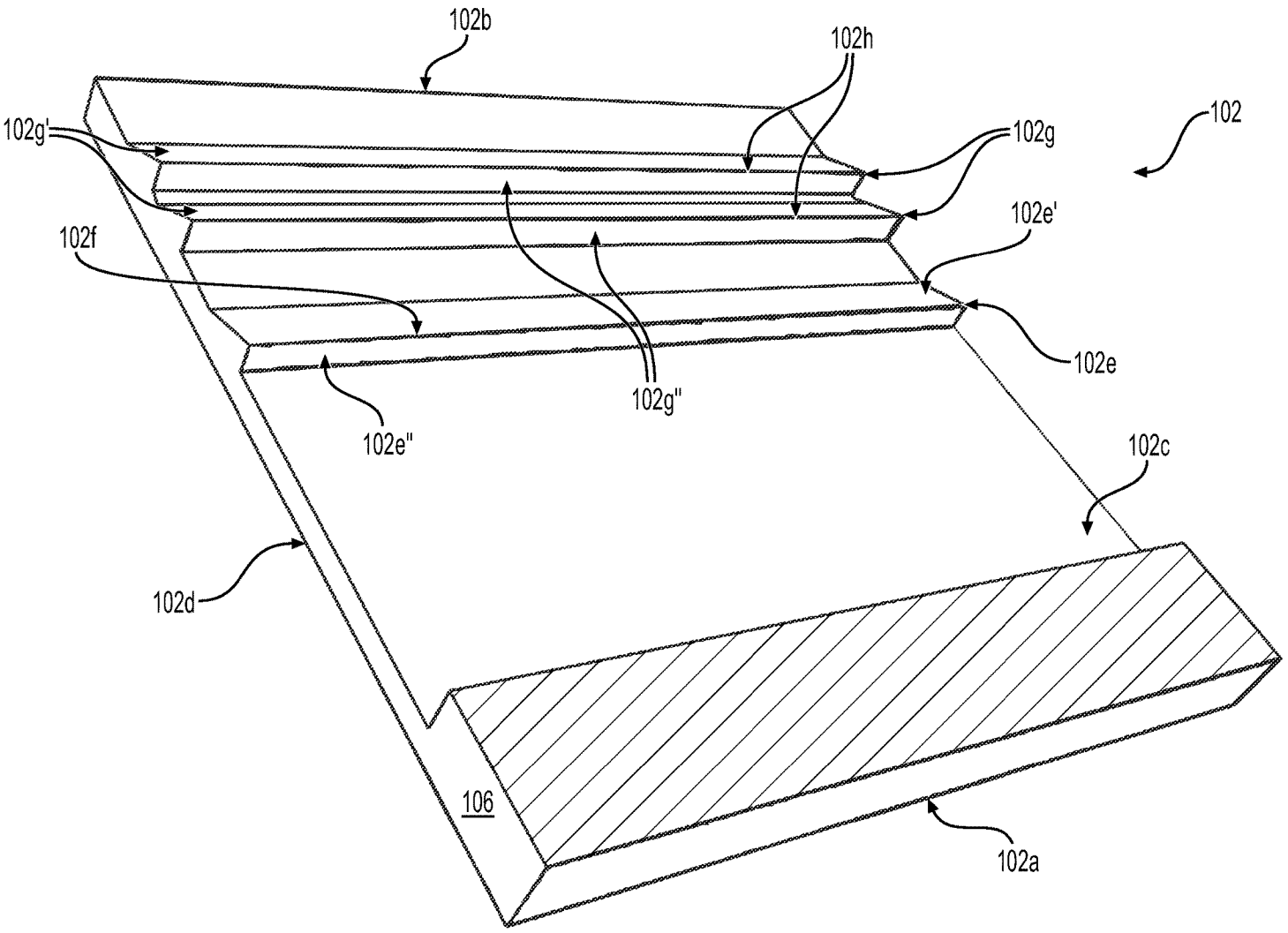
FIGS. 3A and 3B are views of respective inward faces of the device of FIG. 1.
Figure 3B:
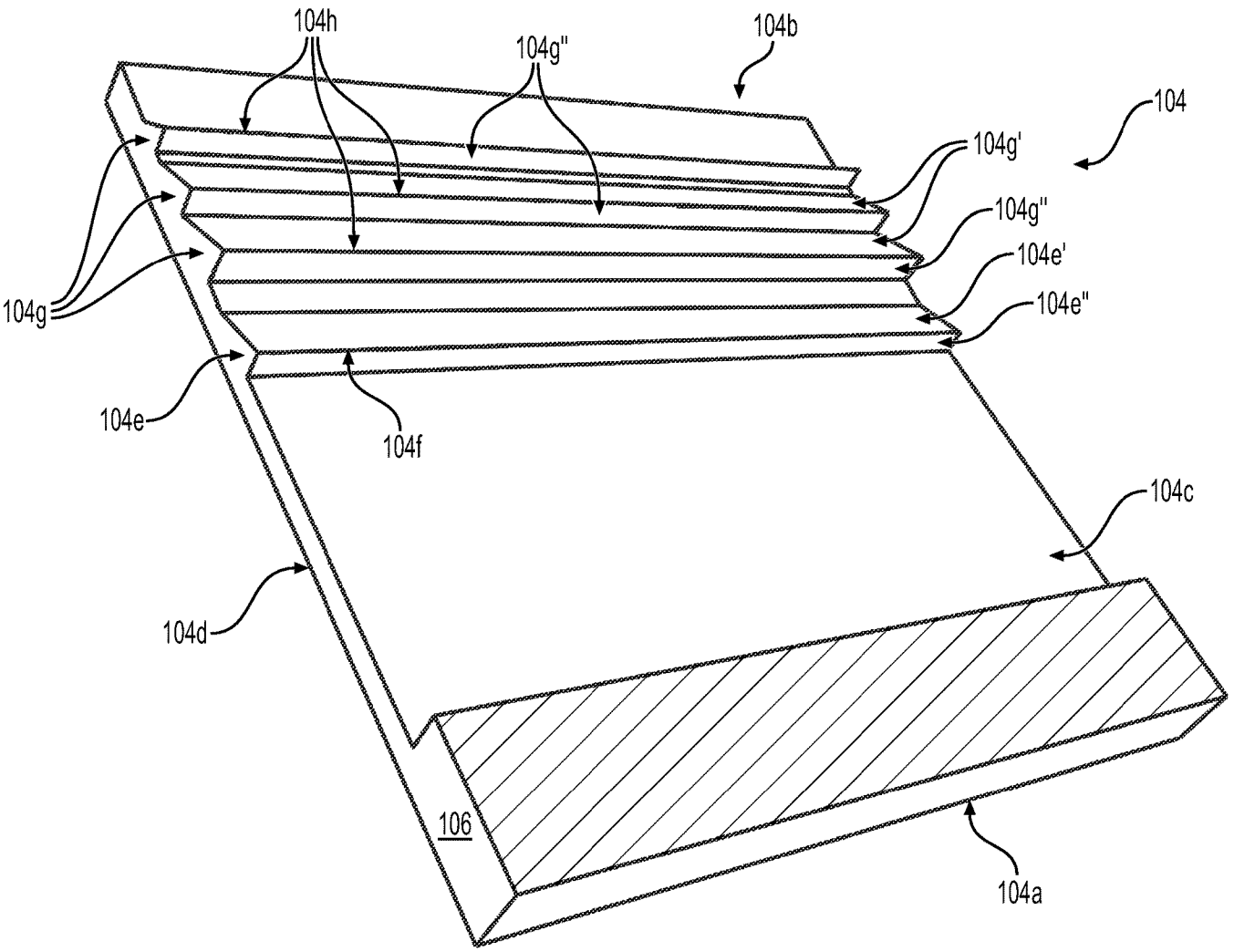
Figure 4:
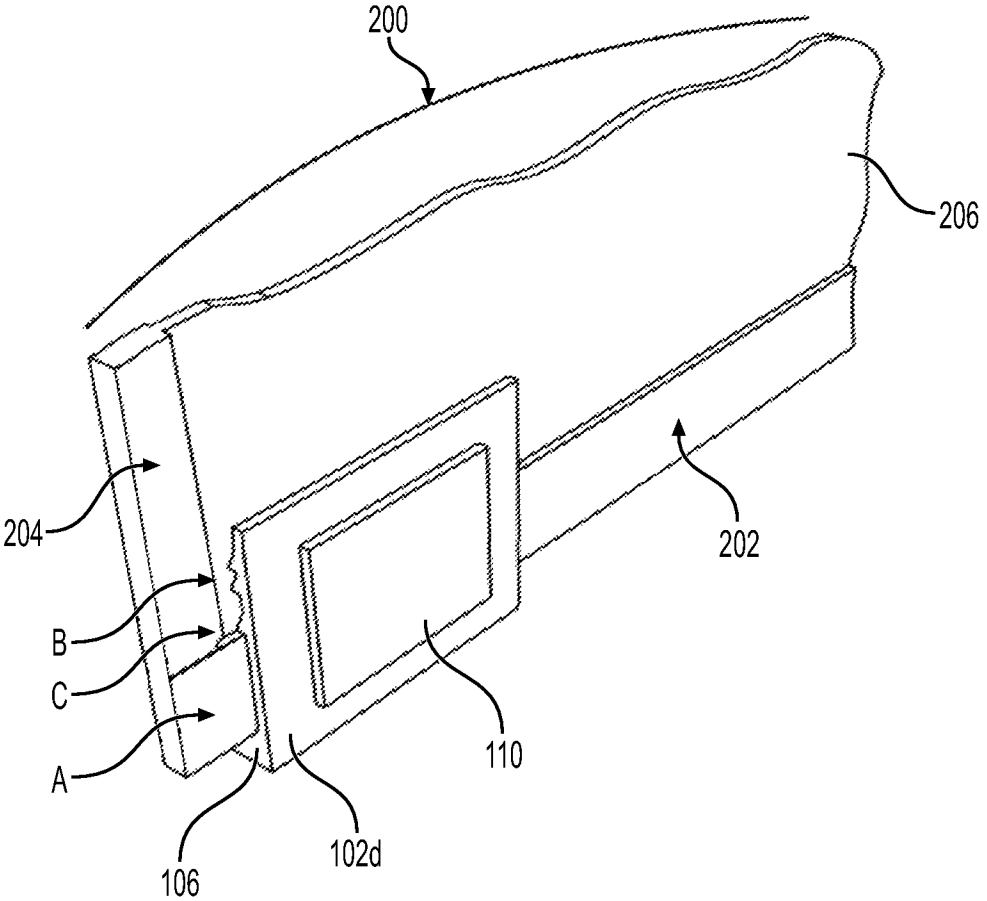
FIG. 4 is a perspective view of an example device of the present invention as attached to an example textile article, such as a towel, in use according to the present invention.

In general, FIGS. 1-3B illustrate a first embodiment of a marking device according to the present invention. FIG. 4 illustrates a use of the marking device according to the present invention, engaged with an edge of a textile article.

FIG. 1 is a reverse perspective view of a marking device 100 according to the present invention. FIG. 2 is a left side view of the device 100 with a better view of the interior structure of device 100. The marking device 100 includes a first wall portion 102 having a proximal edge (sometimes referred to herein as a first end) 102*a* and a distal edge (sometimes referred to herein as a second end) 102*b*, a second wall portion 104 having a proximal edge (sometimes referred to herein as a first end) 104*a* and a distal edge (sometimes referred to herein as a second end) 104*b*, and a base portion 106 located at a proximal part of the device 100 and extending between the proximal edge 102*a* and proximal edge 104*a* so as to fixedly join or otherwise integrally fix the first wall portion 102 and second wall portion 104 together in a spaced apart and opposing configuration. In a preferred example of the present invention, the marking device 100 is a one-piece element (whether actually formed as a single piece in manufacture or in net effect by fixedly joining constituent parts to obtain a single element).

The first wall portion 102 has an inward face 102*c* and an outward face 102*d*. Likewise, the second wall portion 104 has an inward face 104*c* and an outward face 104*d*. Inward faces 102*c* and 104*c* are generally spaced apart and in opposition to one another. FIG. 3A and FIG. 3B are perspective views of first wall portion 102 and second wall portion 104, respectively, as if device 100 were cut through base portion 106 and principally showing the respective inward faces 102*c*, 104*c* (and various structures formed thereon).

With respect to each other, the first and second wall portions 102, 104 are preferably oriented in a range between substantially parallel to one other and generally convergent in a proximal-to-distal direction of the device 100, inclusive. The first and second wall portions 102, 104 are more preferably generally convergent in a proximal-to-distal direction of the device 100, without making the distal edges 102*b*, 104*b* intersect or otherwise contact one another (i.e., while maintaining a predetermined spacing between distal edges 102*b*, 104*b*). In a particular example of the present invention, the first and second wall portions 102, 104 each converge towards one another at an angle of, for example, about three degrees from horizontal. The first and second wall portions 102, 104 are resiliently deflectable away from each other when, for example, an edge of a textile article of a given thickness is passed therebetween (see, for example, FIG. 4, discussed in more detail below).

The inward convergence of first and second wall portions 102, 104 towards each other generally helps ensure that a textile edge received therebetween generates some degree of a resilient spring force by resiliently deflecting (i.e., forcing) the first and second wall portions 102, 104 away from each other. The magnitude of the deflection generally can be dependent on the loft or thickness of the textile to which the device 100 is attached—a thicker material (such as thick or plush bath towel) may need a relatively low degree of inward angling, while a thinner textile article (such as a bed linen) can benefit from a higher angle of convergence in order to assure a sufficient deflection of the first and second wall portions 102, 104 (despite the relative thinness of the textile article), to generate a "bite" or a grip on the thin article generated by the resultant spring force of the device.

As is well known in mechanical dynamics, the spring force is generated by such deflection of the first and second wall portions 102, 104, in proportion to a degree of deflection of each wall portion. Such spring force tends to return the first and second wall portions 102, 104 towards a rest state (i.e., a state without deflection). Accordingly, a convergent configuration of the first and second wall portions 102, 104, as described, can in particular usefully increase the resultant returning spring force by necessarily increasing the magnitude of the deflection of the first and second wall portions. This returning spring force helps the first and second wall portions "grip" an edge of a textile article therebetween to thereby help retain the attachment of the device 100 onto the article in question.

As shown in FIG. 2, the device 100 can be generally divided along a direction between the proximal and distal edges 102*a*, 102*b* and 104*a*, 104*b* into an intermediate region A having a first retaining rib (as discussed below), a distal region B having a plurality of second retaining ribs (as discussed below), and a proximal region C without retaining ribs and defining a catch channel (as discussed below).

More specifically, an intermediate part of inward faces 102*c*, 104*c* are each provided with respective first retaining ribs 102*e*, 104*e*, respectively, in region A. Each first retaining rib 102*e*, 104*e* extends widthwise transversely along a direction generally perpendicular to a direction between the proximal edges 102*a*, 104*a* and distal edges 102*b*, 104*b*. See, for example, FIGS. 3A and 3B. Each first retaining rib 102*e*, 104*e* generally projects or protrudes inwardly (i.e., towards the opposing inward face) from inward faces 102*c*, 104*c*, respectively, and is spaced away from the base portion 106 along a direction from the proximal edges 102*a*, 104*a* towards the distal edges 102*b*, 104*b*. In a particular example of the present invention, the first retaining ribs 102*e*, 104*e* each have a generally triangular cross-section (i.e., taken transverse to its direction of extension) and respective apex (i.e., peak) edges 102*f*, 104*f*.

In addition, the height of first retaining ribs 102*e*, 104*e* (i.e., the distance that each extends away from inward faces 102*c*, 104*c*, which in turn controls a distance between respective peak edges 102*f*, 104*f*) can be varied in manufacture in accordance with a thickness of the textile article (particularly in accordance with a thickness of an end hem 202 (see, for example, FIG. 4 and the written description below corresponding thereto).

In a preferred embodiment, the respective apex edges 102*f*, 104*f* of the first retaining ribs 102*e*, 104*e* are substantially aligned in opposition to each other, taken along a direction from the proximal edges 102*a*, 104*a* towards the distal edges 102*b*, 104*b*. See, for example, the alignment of edges 102*f*, 104*f* substantially in opposition in FIGS. 1 and 2.

The marking device 100 is further provided with a plurality of second retaining ribs 102*g*, 104*g* on the inward faces 102*c*, 104*c* respectively, distal to the first retaining ribs 102*e*, 104*e* (i.e., in the region B seen in FIG. 2). The second retaining ribs 102*g*, 104*g* extend widthwise transversely along a direction generally parallel to the base portion 106. See, for example, FIGS. 3A and 3B.

In a particular example of the present invention, the second retaining ribs 102*g*, 104*g* each have a generally triangular cross-section (i.e., transverse to its direction of extension). Second retaining ribs 102*g* have respective apex edges 102*h*, while the second retaining ribs 104*g* have respective apex edges 104*h*. See, for example, FIGS. 3A and 3B, in which first wall portion 102 is provided with two second retaining ribs 102*g* and second wall portion 104 is provided with three second retaining ribs 104*g*, by way of example.

Differently from the first retaining ribs 102*e*, 104*e*, the respective apex edges 102*h*, 104*h* of the second retaining ribs 102*g*, 104*g* are preferably offset from each other along a direction from the proximal edges 102*a*, 104*a* towards the distal edges 102*b*, 104*b*, such that at least some of the apex edges 102*h* are aligned relatively between (in a direction from the proximal edges 102*a*, 104*a* towards the distal edges 102*b*, 104*b*) respective adjacent apex edges 104*h* on the opposite inward face, or vice versa, as can be seen in FIGS. 1 and 2. Recall, in comparison, that the first retaining ribs 102*e*, 104*e* have apex edges 102*f*, 104*f* that are preferably substantially aligned with one another along the direction from the proximal edges 102*a*, 104*a* towards the distal edges 102*b*, 104*b*, as can be seen in the figures.

In order to facilitate the offset arrangement of the second retaining ribs 102*g* relative to the second retaining ribs 104*g*, a different number of second retaining ribs 102*g* may optionally be provided compared to the number of second retaining ribs 104*g*, or vice versa. Strictly by way of illustrative example, FIGS. 1-3B show a device 100 provided with two second retaining ribs 102*g*, compared to three second retaining ribs 104*g*. For example, the two second retaining ribs 102*g* can be spaced more flexibly (e.g., farther apart from each other) on inward face 102*c* in region B so that the apex edges 104*h* of second retaining ribs 104*g* can be more easily arranged relative to the apex edges 102*h* of second retaining ribs 102*g*, as described above. Reducing the "crowding" of elements in this way can additionally potentially facilitate manufacture (e.g., by molding).

Also, the offset, alternating relative arrangement of second retaining ribs 102*g* relative to second retaining ribs 104*g* allows the respective converging first and second wall portions 102, 104 to approach each other more closely because the second retaining ribs 102*g*, 104*g* can essentially nest relative to one other without apex edges 102*h*, 104*h* contacting each other. This means that resilient spring force generated by the deflection of wall portions 102, 104 away from each other when an edge of a textile article is received therebetween will be relatively even stronger, thereby enhancing the "grip" of device 100 on the textile article.

Additionally, the height (i.e., the extent to which the second retaining ribs extend outwardly from inward faces 102*c*, 104*c*) of respective second retaining ribs 102*g*, 104*g* could be made larger because of this alternating arrangement. This may also enhance the gripping effect of the device 100.

The specific respective numbers of second retaining ribs 102*g*, 104*g* is not critical beyond providing a plurality of each, in accordance with the foregoing.

Corresponding proximal (relative to base portion 106) portions (i.e., region C seen in FIG. 2) of inward faces 102*c*, 104*c* have no retaining ribs on respective inward faces 102*c*, 104*c*, thereby defining a relatively wider catch channel 108 therebetween, as will be discussed in more detail below (particularly relative to FIG. 4).

The marking device 100 is preferably made from a relatively inexpensive and preferably somewhat resiliently flexible material, such as a polymer resin or other plastic material. One example of a suitable, commercially available material is polylactic acid (PLA) plastic filament, formed using, for example, a commercially available Monoprice Cadet 3D printer (model 140108). PLA plastic filament is a popular matrix material used in 3D printing because it is both relatively inexpensive and versatile.

However, where higher temperature environments (e.g., higher than about 140° F.) are anticipated or may be potentially encountered, PLA may not be sufficiently heat-resistant. For example, it may be desirable and/or convenient to leave a marking device 100 attached to a given textile article while it is being washed and dried (generally, cleaned and/or sanitized), or it may even occasionally be inadvertently left attached when the article is cleaned. In the latter case, it is desirable to avoid a situation where the device may melt and potentially ruin either the textile article or a washer or dryer. Given a range of known dryers, heat resistance of even up to about 180° F. may be desirable.

An ideal plastic material used in the manufacturing process would therefore be resilient and heat resistant while maintaining flexibility/resilience and resistance to material fatigue and/or failure (after repeated flexing in use). Examples of materials with relatively higher heat resistance that could be used to manufacture marking device 100 include commonly known acrylonitrile butadiene styrene (ABS) (which has a glass transition temperature of about 221° F.), or polypropylene (which has a glass transition temperature of about 500° F.) and is resistant to fatigue.

Alternatively, marking device 100 could be manufactured using injection molding according to standard manufacturing practices, rather than 3D printing (e.g., to facilitate manufacture on a large scale).

Polymeric materials such as that/those mentioned above are ideal for the manufacture of device 100 because they are relatively inexpensive, and thus lend themselves to inexpensive mass production of the device 100. Once formed, the resultant devices 100 are suitably durable for a useful time period of use. In certain cases, polymeric materials can be used that are or can be made resistant to microbial contamination, such as by incorporating antimicrobial additives into polymeric materials, such as additives commercially available from, from example, Microban International, Ltd., of Huntersville, N.C.

Alternatively, a metallic material could be used to manufacture device 100, but it must be appropriately resistant to rust, discoloration, or other oxidation, particularly in order to avoid transferring stains to the textile article with which it is used.

FIG. 4 is a perspective view of a marking device 100, as described above, attached to a corner portion of a textile article, such as, for example and without limitation, a bath towel 200. Using a bath towel 200 as an illustrative example, the towel 200 characteristically includes an end hem 202 on an end edge thereof, and a finished edge (sometimes referred to as a selvage in the textile arts) 204 on side edges (i.e., the edges extending between the respective opposing end edges 202. In some cases, it is known in the textile arts that the end hem 202 and/or the selvage edges 204 are formed to be relatively thicker than an interior area 206 of the towel. In some cases, end hem 202 in particular is substantially thicker than interior area 206.

In use, the marking device 100 of the present invention can be slipped over an end hem 202 (for example) of the towel 200 in the manner illustrated in FIG. 3, received between the first and second wall portions of the device 100. Depending on the underlying article, the device 100 can be pushed "onto" the article by forcing end hem 202 between distal edges 102*b*, 104*b* in a direction from the distal edges 102*b*, 104*b* towards the proximal edges 102*a*, 104*a* until all or a major portion of end hem 202 is received in the catch channel 108.

In another example of use, the device 100 can be slid laterally over end hem 202—that is, the device 100 can be, for example, placed to one side of end hem 202, with end hem 202 aligned with catch channel 108 (see FIG. 2). The device 100 can then be slid laterally onto end hem 202 (i.e., along the direction of extension of end hem 202), while, if needed, manually (for example) pulling apart first and second wall portions 102, 104 in order to facilitate reception of the end hem 202 therebetween.

First, the catch channel 108 (as defined, in part, by opposing first retaining ribs 102*e*, 104*e* at the distal end thereof; see, for example, region C in FIG. 2) in effect receives and retains all or a part of the relatively thick end hem 202 of the towel 200. In particular, the natural resilience of the first and second wall portions 102, 104, which are generally pushed away from each other by the thickness of towel 200 held therebetween, generates a reaction spring force which tends towards narrowing the space between the opposing apex edges 102*f*, 104*f* of the first retaining ribs 102*e*, 104*e* (i.e., towards a "rest" (undeflected) position of the device 100). This therefore tends to resist the ability of the thickened end hem 202 to pass back outwards from the catch channel 108. In addition, this spring force tends to force the opposing apex edges 102*f*, 104*f* into the relatively soft thickness of the towel 200 with a kind of a pinching or gripping effect to further help retain the marking device 100 in place relative to towel 200.

In addition, the second retaining ribs 102*g*, 104*g* (at region B) further resist movement of the end hem 202 relative to the marking device 100, because at least a part of interior area 206 is effectively pinched between the opposing second retaining ribs 102*g*, 104*g* also thanks to the spring force generated in reaction to the outward deflection between the first and second wall portions 102, 104 caused by the thickness of towel 200.

It will be appreciated that the alternating arrangement of the opposing second retaining ribs (i.e., so that the apex edges of the second retaining ribs on one inward face alternate with the apex edges on the other inward face), if used, further enhances the retaining effect between the opposing pluralities of second retaining ribs 102*g*, 104*g*, thanks to the material of the textile article being "gripped" along an undulating surface between the alternating second retaining ribs 102*g*, 104*g*. However, because the towel 200 is not directly mashed between opposing apex edges 102*f*, 104*f*, the fabric of towel 200 is at least somewhat protected from damage or wear.

As mentioned above, the first (102*e*, 104*e*) and second (102*g*, 104*g*) retaining ribs characteristically have triangular cross sections. In addition, in a particular example of the present invention, the cross section of at least some of the first and second retaining ribs is approximately that of a right triangle with the hypotenuse facing "forward" towards the respective distal edges 102*b*, 104*b*. As a result, each first and second retaining rib having the approximate right triangular cross section presents a distal-facing inclined surface (102*e*', 104*e*', 102*g*', 104*g*'), terminating in the previously mentioned respective apex edges (102*f*, 104*f*, 102*h*, 104*h*). See, particularly, FIGS. 3A and 3B. On the other side of the apex edge of a given retaining rib having such an approximate right triangular cross section, another surface (102*e*", 104*e*", 102*g*", 104*g*") of the given retaining rib is perpendicular or near-perpendicular to the underlying inward face 102*c*, 104*c* on which the retaining rib is located.

On the one hand the inclined surfaces (102*e*', 104*e*', 102*g*', 104*g*') of the respective first and second retaining ribs facilitates the movement of an edge of a towel 200 between the first and second wall portions 102, 104 in a distal-to-proximal direction (i.e., when the device 100 is initially placed on the towel).

However, once the marking device 100 is suitably placed on the edge of a towel or the like (as seen in FIG. 4, for example), the other, perpendicular or near-perpendicular faces (102*e*", 104*e*", 102*g*", 104*g*") of the respective retaining ribs (i.e., the surfaces on the proximal side of the respective apex edge) tends to cause each retaining rib to, in effect, dig into or burrow into the soft/plush surface of towel 200 when a pulling force is applied to the towel 200 in a proximal-to-distal direction (i.e., in a direction that would otherwise pull towel 200 out from the marking device 100). This retaining effect could potentially even between further enhanced by slightly angling one or more of those surfaces 102*e*", 104*e*", 102*g*", 104*g*" in a proximal direction towards the base portion 106 (e.g., by a few degrees—such as about 2-5 degrees or less), in a direction from the respective inner face 102*c*, 104*c* towards a respective apex edge. This feature is currently not seen in the figures.

In order to remove the marking device 100 from placement on a textile article such as towel 200, the respective first and second wall portions 102, 104 can, for example, be gently forced apart (e.g., by gently pulling on the distal edges 102*b*, 104*b* with one's fingertips until the "grip" of the device 100 (e.g., via the first and/or second retaining ribs) is sufficiently loosened to permit the device 100 to be pulled off of the edge of the article (along the proximal-to-distal direction of the device). Alternatively, the device 100 can be slid off the article (generally, in a direction parallel to end hem 202). Again, the respective first and second wall portions 102, 104 can be manually forced apart (as described above) in order to loosen the grip of the device 100 on the underlying article.

As mentioned at the outset, the marking device 100 is particularly useful for distinguishing between textile articles, particularly for easily identifying or otherwise distinguishing a particular article among a plurality of identical or similar looking articles. A particular example of this situation is with respect to bath linens provided in, for example, a hotel or the like, in a hospital, or in a gym/health club/spa, where large numbers of essentially identical towels and the like are regularly distributed.

Accordingly, the marking device 100 is readily suitable for being marked or otherwise labeled with visually-identifiable unique indicia such as a personal name; number(s); words (like "Dad" or "Mom" for example); symbols (including, for example and without limitation, corporate logos and the like); pictures; etc., or combinations thereof. Such indicia can be added by any conventional marking/printing method as long as it is suitable for the underlying material of manufacture. Some possibilities include, without limitation, direct printing, etching, adhesive decals bearing the desired indicia, painting, etc.

The marking device 100 can be additionally (or alternatively) be made uniquely identifiable by providing it with a characteristic color or pattern of colors. The color(s) may be provided by either choosing a material of manufacture with a desired color, or by applying color(s) by any conventional means compatible with the underlying material of manufacture (for example, without limitation, by painting or by application of an appropriately colored adhesive decal).

Suitable visually-identifiable indicia could be provided, for example, on either or both of outward faces 102*d* and 104*d*, but any exterior-facing surface of device 100 could be potentially used in this regard.

In addition or alternatively, the marking device 100 could be provided with tactilely-identifiable indicia (not seen in the figures), such as raised (relief) markings or sunken markings formed in a surface of marking device 100 (such as by etching and the like). Such tactilely-identifiable indicia could be of a type intended to be principally identified/interpreted by touch (such as indications set out in Braille), or of a type that could identified/interpreted visually and/or tactilely (such as visible raised or sunken alphanumeric character combinations including specific words, or, for example, geometric symbols like a triangle, circle, square, etc.).

Figure 7A:
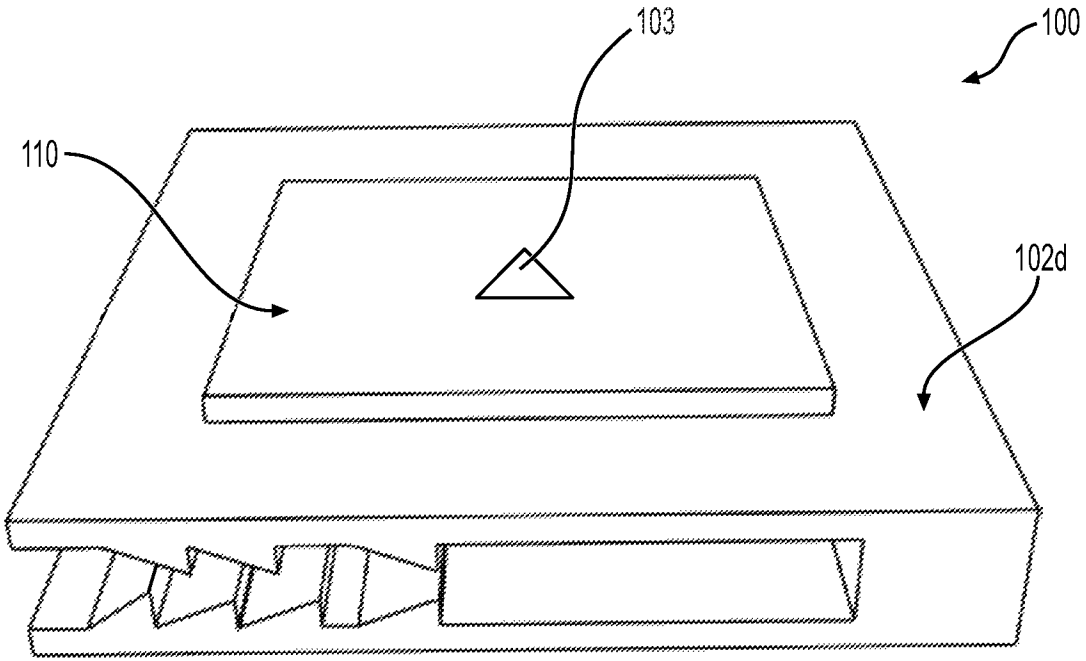
FIGS. 7A, 7B, and 8 illustrate additional structural features, applicable to both the first and second embodiments of the present invention.
Figure 7B:
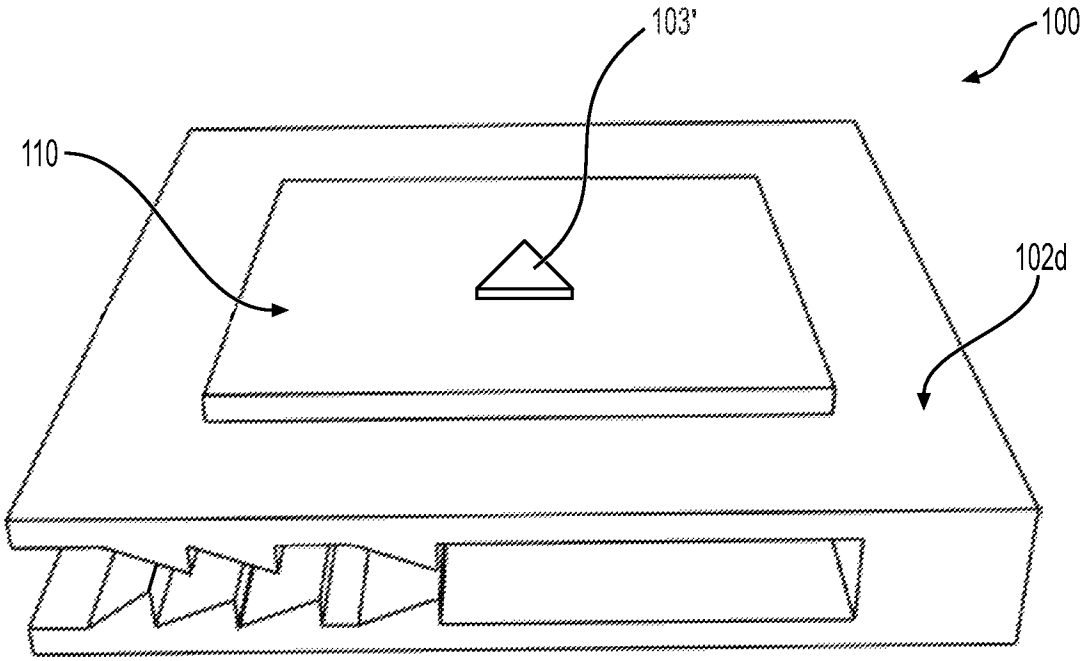
Figure 8:
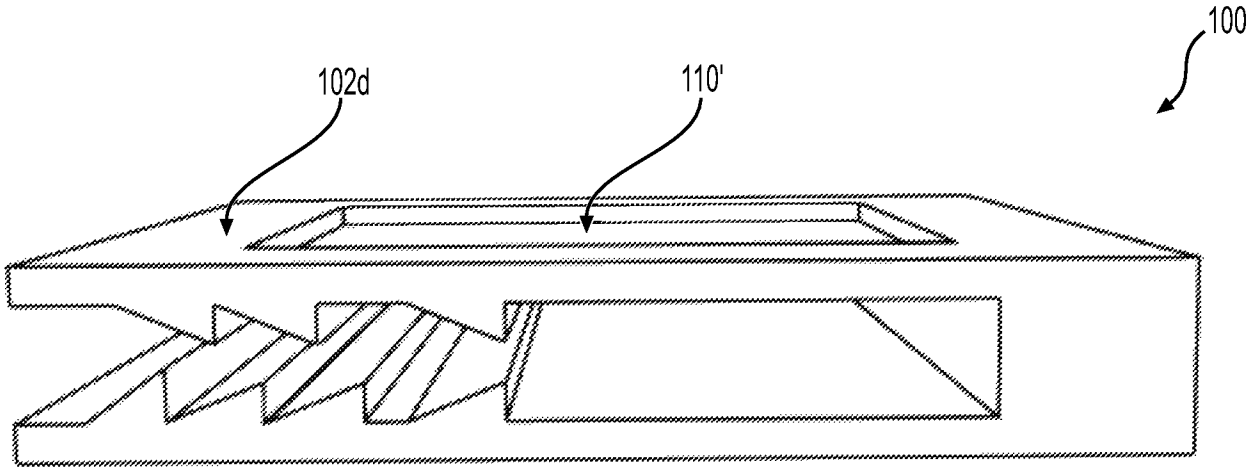

In some cases, the marking device 100 may be provided with a distinct region, such as, for example, a raised rectangular region 110 provided on outward face 102*d* (see, for example, FIGS. 2, 4, and 7, and also element 310 in FIG. 5) or a sunken or recessed region 110' formed in outward face 102*d* as seen in FIG. 8. In particular, tactilely-identifiable indicia (whether or not also visually identifiable) can be beneficially provided within region 110 or 110'—the raised/sunken portion serves as a readily perceivable tactile guide to initially indicate (via touch alone) where generally the identifying indicia are to be found (i.e., in particular, on which side of the marking device). Strictly by way of example, FIG. 7A illustrates an example of a visually identifiable feature 103 provided on raised region 110 (formed thereon by, for example, printing), and FIG. 7B illustrates an alternative example of a tactilely identifiable feature 103' (that happens to be additionally visually recognizable) provided on the region 110 (formed, for example, during molding or 3D printing).

Another (or additional) option is to provide the marking device 100 with a characteristic, relatively distinct, artificial scent, with or without combination with visual and/or tactile identifying indicia. Ideal examples of suitably distinct scents are pine, cinnamon, coffee, etc.—it is preferable to use distinct and readily identifiable (or, at least, readily distinguishable) scents in according to the present invention, rather than, for example, floral scents, which may generally be identifiable as floral, but which may be practically difficult to distinguish among other floral scents. Methods of impregnating plastic materials and the like with desired scents are conventionally known and are disclosed in, for example, published international patent application WO9830621 (A1), dated Jul. 16, 1998, in the name of Antonio Campagnoli, the disclosure of which is incorporated herein by reference to the fullest extent permissible.

Figure 5:
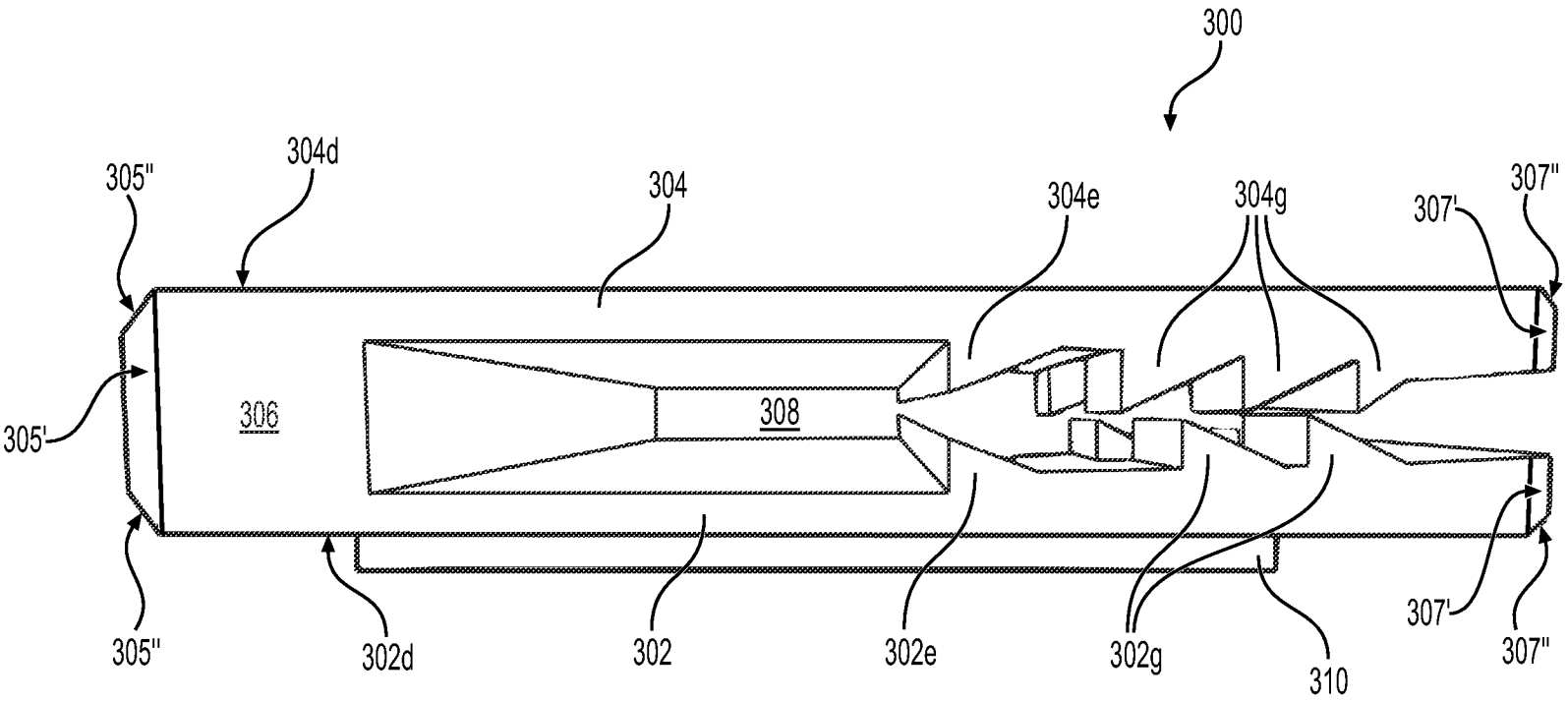
FIG. 5 is a left side view of a first variant of a second embodiment of the device of the present invention.
Figure 6A:
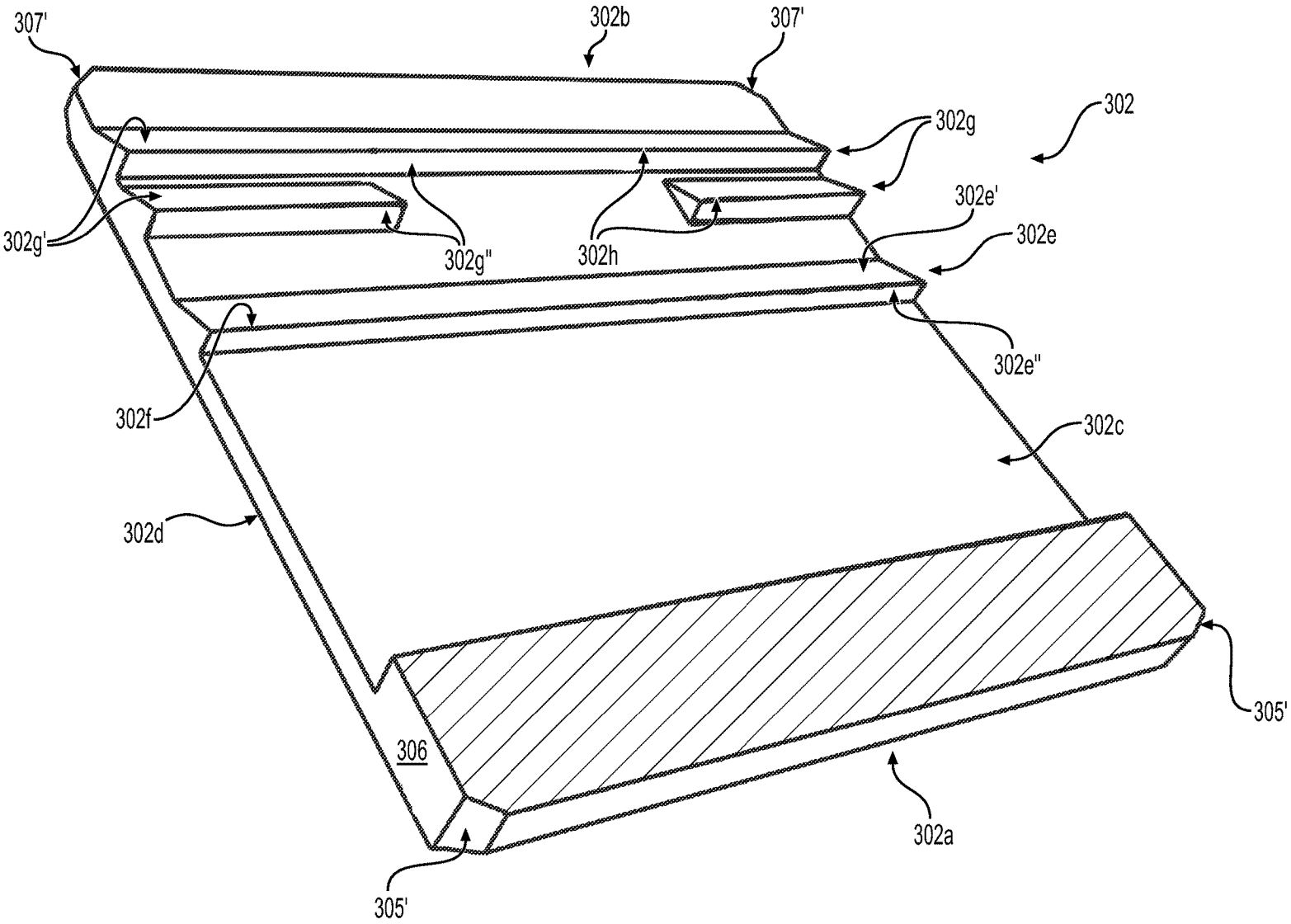
FIGS. 6A and 6B are views of respective inward faces of the device of FIG. 5.
Figure 6B:
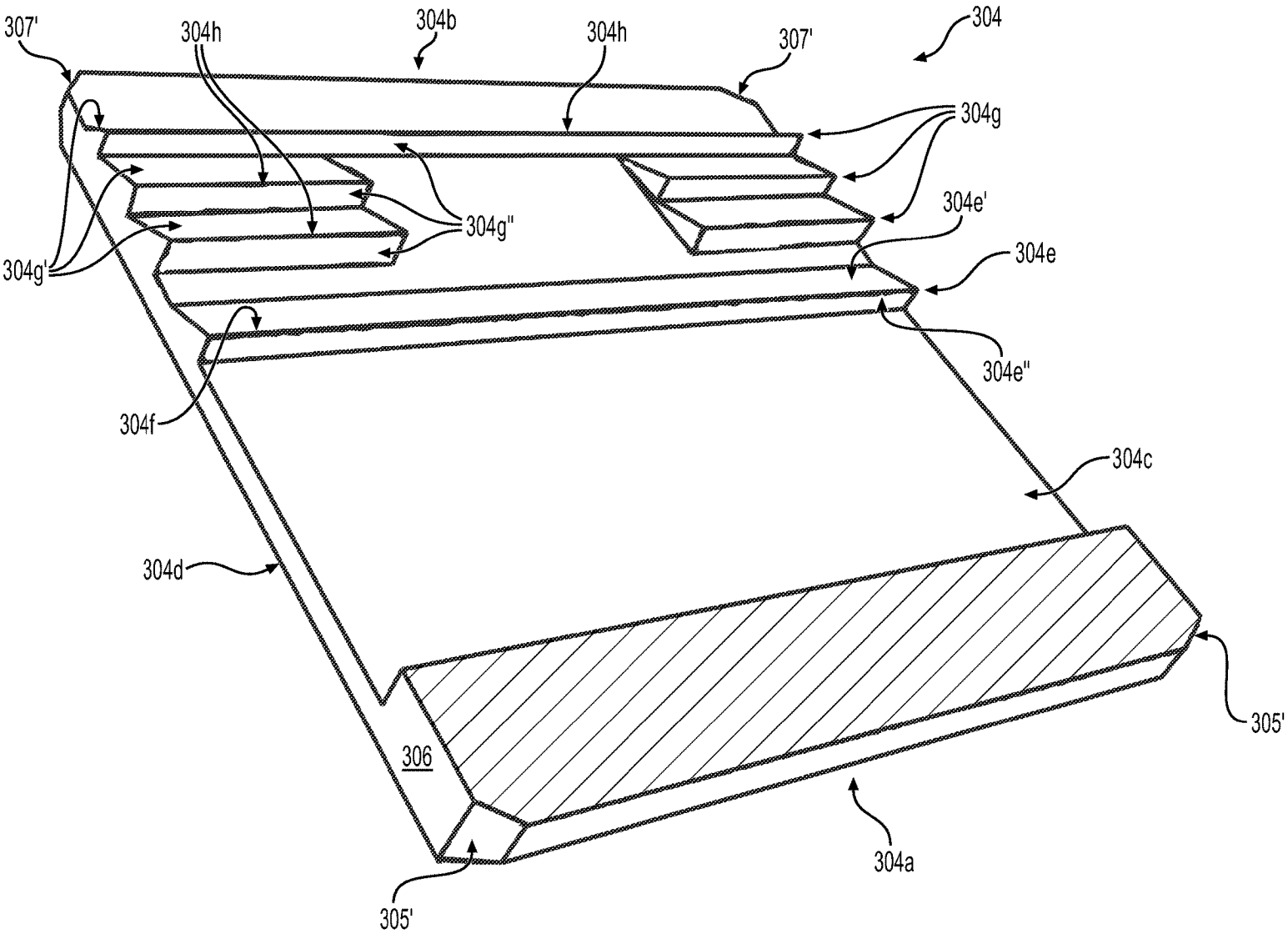
Figure 6C:
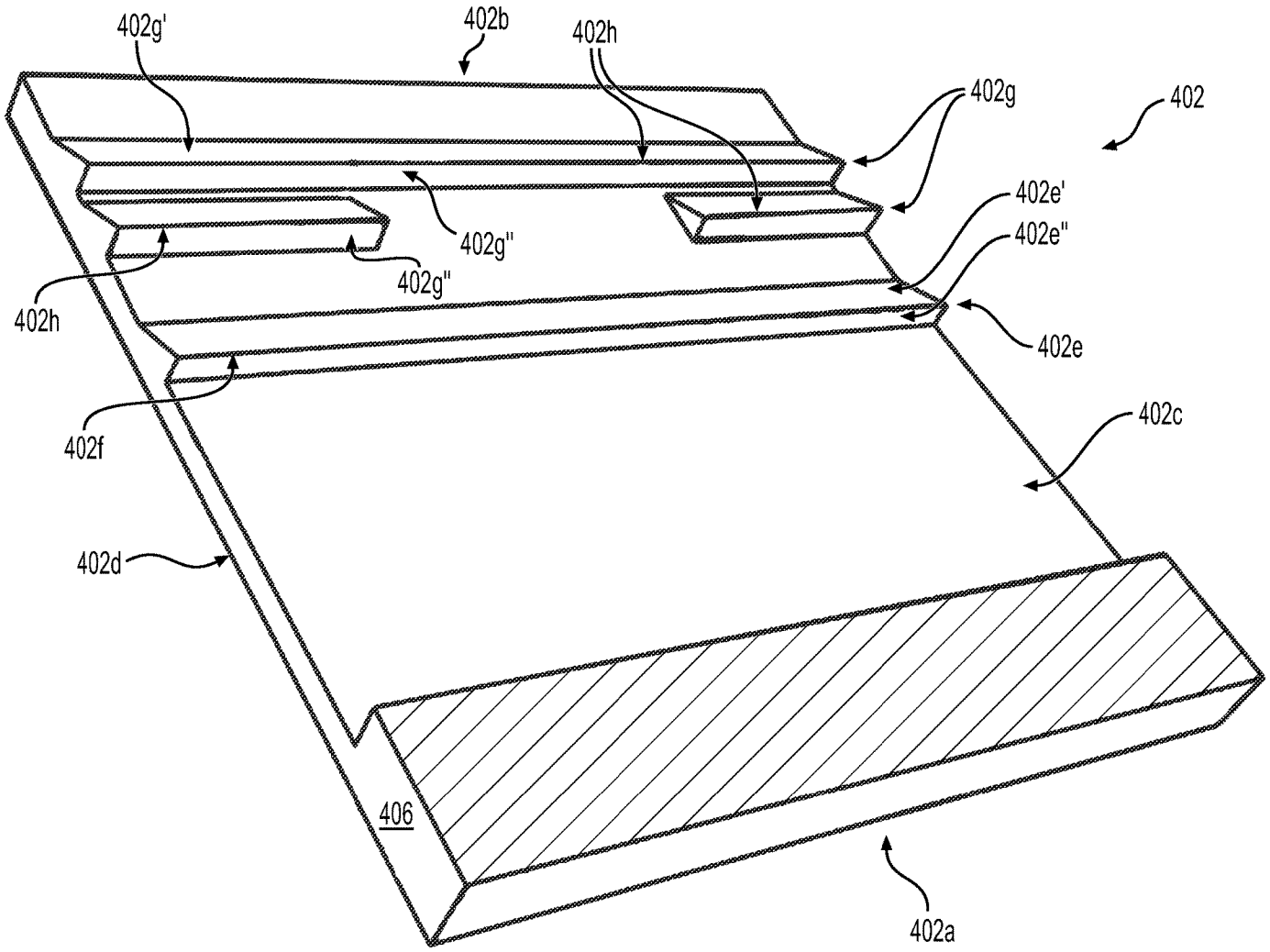
FIGS. 6C and 6D are view of respective inward faces of a second variant of the second embodiment.
Figure 6D:
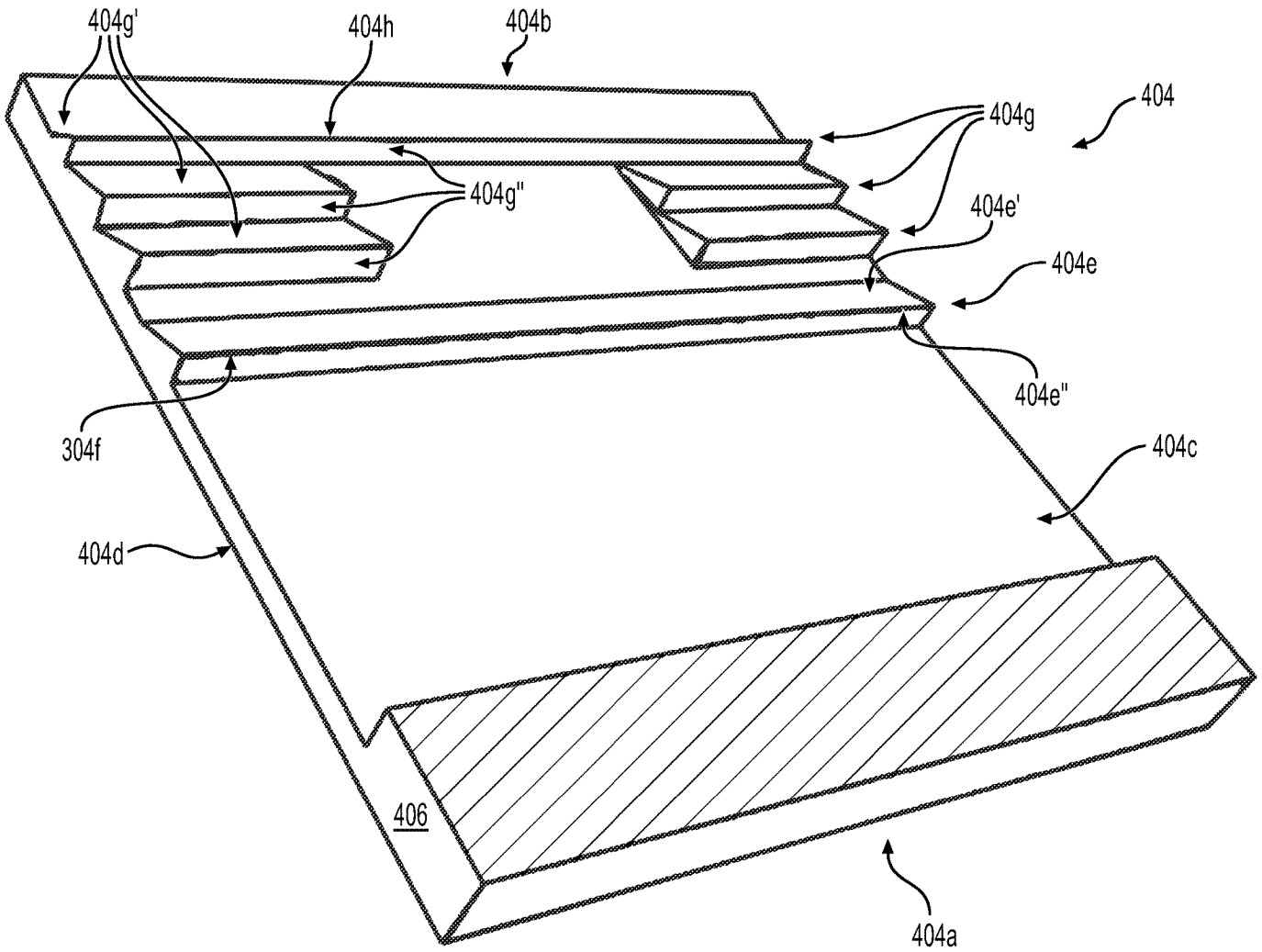

FIG. 5-6D illustrate a second embodiment of the present invention, in which, particularly, all of the first and/or second retaining ribs need not necessarily extend continuously across a width of the marking device.

FIG. 5 is a left side view of a device 300, generally analogous to the view of device 100 in FIG. 2. As in device 100, device 300 most generally comprises first and second wall portions 302, 304, extending in a distal direction from a base portion 306 which joins or is otherwise integral with proximal ends 302*a*, 304*a* of the first and second wall portions 302, 304 in a manner which generally maintains first and second wall portions 302, 304 in a spaced apart configuration. In turn, respective distal ends 302*b*, 304*b* remain spaced apart.

The general structure of device 300 in FIGS. 5-6D is analogous to the structures noted in device 100 with respect to FIGS. 1-4, and the detailed explanations above relative to FIGS. 1-4 generally apply equally to the visibly corresponding features in device 300 illustrated in FIGS. 5-6D. The disclosure above relative to device 100 is therefore incorporated here to the fullest extent permissible (including disclosure regarding function and material(s) of manufacture), subject to the details set forth below. Accordingly, not every structural detail in device 300 that has been already been described relative to device 100 may necessarily be expressly described again hereinbelow, and any omission of express description relative to the structure shown in FIGS. 5-6D is not to be taken as a disclaimer, but rather an attempt to avoid unnecessary repetition of the description relative to FIGS. 1-4.

The first wall portion 302 has an inward face 302*c* and an outward face 202*d*. Likewise, the second wall portion 304 has an inward face 304*c* and an outward face 304*d*. Inward faces 302*c* and 304*c* are generally spaced apart and in opposition to one another. FIG. 6A and FIG. 6B are perspective views of first wall portion 302 and second wall portion 304, respectively, as if device 300 were cut through base portion 306 and principally showing the respective inward faces 302*c*, 304*c* (and various structures formed thereon).

Generally, the inward faces 302*c*, 304*c* have respective first retaining ribs 302*e*, 304*e*, and second retaining ribs 302*g*, 304*g* provided thereon, in a manner and arrangement generally similar to first retaining ribs 102*e*, 104*e* and second retaining ribs 102*g*, 104*g* in device 100.

With reference to FIGS. 6A and 6B in particular (and also FIG. 5), a primary feature of the second embodiment of the present invention is that one or more of the second retaining ribs 302*g* and/or 304*g* do not extend continuously across a width of device 300, unlike the second retaining ribs of the first embodiment. For example, in FIG. 6A, the proximal one of the second retaining ribs 302*g* is interrupted along its transverse length by a gap at an intermediate portion thereof, whereas the intermediate and proximal second retaining ribs 304*g* are similarly interrupted by respective, similarly sized gaps at respective intermediate portions, as seen in FIG. 6B. Generally, the gap(s) in the second retaining rib(s) 302*g* are of a similar size to gap(s) in second retaining rib(s) 304*g*. Preferably, but not necessarily, the gap(s) in second retaining rib(s) 302*g* and 304*g* are aligned with one other to be substantially aligned and in opposition to one another. Each second retaining rib may be provided with more than one gap along its transverse extent, and the location of the gap(s) in a second retaining rib need not necessarily be centered along its transverse extent.

Similar gap(s) could be provided in the respective first retaining ribs 302*e*, 304*e* subject to similar considerations as noted above relative to second retaining ribs 302*g*, 304*g* (even though not currently illustrated).

A purpose of providing one or more gaps in the retaining ribs as described and illustrated by way of example in FIGS. 5-6B is to provide relatively improved resistance to lateral movement of the device 300 when attached to an underlying textile article (like towel 200 in FIG. 4). In general, a given gap along the length of extent of a given retaining rib tends to let the loft or "fluffiness" of the underlying textile article remain relatively uncompressed compared with portions of the textile article directly contacting/opposing the adjoining retaining rib portions. The laterally inward ends of the given retaining rib (between which the gap extends) tends to also dig into the thickness of the textile article in addition to the laterally outward facing ends of the given retaining rib. This tends to resist lateral sliding of the marking device (particularly inadvertently), for example along the length of end edge 202 as seen in FIG. 4. Thus, this features helps resist inadvertent removal of the device 300, especially via inadvertently moving laterally (e.g., parallel to end hem 202, as in FIG. 4).

It will be appreciated that the marking device of the present invention is generally described and illustrated (strictly by way of example) as having a square (or, more generally, rectangular form) as seen in plan.

An additional optional feature of the present invention (illustrated herein relative device 300 of the second embodiment, but equally applicable to device 100 of the first embodiment discussed above relative to FIGS. 1-4), is to flatten, round, or, for example, bevel exterior corners of the device 300, thereby leaving, for example, surfaces 305' and 305" at a proximal end of device 300, and surfaces 307' and 307" at a distal end of device 300. See, particularly, FIG. 5. In general, all such otherwise orthogonal corners (between adjacent surfaces) of the device according to the present invention could be optionally but beneficially beveled or at least otherwise rounded in this manner.

The advantage/benefit of providing beveled (or otherwise rounded or smoothed) surfaces such as surfaces 305', 305", 307' 307" is eliminate or reduce orthogonal surfaces/corners which could snag other textile articles or even uncomfortably scratch a user of the textile article while the textile article is being used with the marking device attached.

FIGS. 6C and 6D illustrate a marking device 400, a variant of the second embodiment illustrated in FIGS. 5, 6A, and 6B but without the same beveled corner surfaces mentioned above. In FIGS. 6C and 6D, features corresponding to those shown in FIGS. 5, 6A, and 6B use 400-level reference numerals rather than 300-level reference numerals as in the latter figures. For example, first retaining rib 304*e* corresponds with first retaining rib 404*e*, second retaining ribs 304*g* correspond with second retaining ribs 404*g*, and so on). As such, the detailed description set forth above relative to FIGS. 5, 6A, and 6B is incorporated here as if repeated in full relative to the subject matter illustrated in FIGS. 6C and 6D, and is therefore not expressly repeated here for the sake of brevity.

The representation of the marking device in the present description as having a square (or at least rectangular) form is strictly by way of example and is not to be taking as limiting. As a practical matter, there are certain relative performance advantages to a square/rectangular form, but the marking device according to the present advantage is believed to be fully functional regardless of the shape used, including whether or not the first and second wall portions have the same form. However, it is likely that it is most preferable that the first and second wall portions of the marking device be identical or substantially similar, in order to obtain best obtain the functional benefits described hereinabove, particularly with respect to functional aspects directly related the positional interrelationship of the first and second wall portions.

Although the present invention is described above with reference to certain particular examples for the purpose of illustrating and explaining the invention, it must be understood that the invention is not limited solely with reference to the specific details of those examples. More particularly, the person skilled in the art will readily understand that modifications and developments that can be carried out in the preferred embodiments without thereby going beyond the ambit of the invention as defined in the accompanying claims.

What is claimed is:

1. A marking device comprising:

a first wall portion having proximal and distal edges and an inward face and an outward face;

a second wall portion having proximal and distal edges and an inward face and an outward face;

a base portion extending between the respective proximal edges of the first and second wall portions so as to space apart the first and second wall portions with the respective inward faces of the first and second wall portions facing each other;

wherein the first and second wall portions are resiliently flexible relative to the base portion, and are generally convergent in a direction from their proximal edges towards their spaced apart distal edges;

wherein the inward face of the first wall portion is provided with a first retaining rib having a width generally extending in a direction parallel to the base portion and a generally triangular cross section, and the inward face of the second wall portion is provided with a corresponding first retaining rib having a width generally extending in a direction parallel to the base portion and a generally triangular cross section, wherein the first retaining ribs have respective opposing apex edges generally aligned with one another;

wherein one or more second retaining ribs are located on the inward faces of the first and second wall portions respectively and distal to the first retaining ribs, the one or more second retaining ribs having a width generally extending in a direction parallel to the base portion and a generally triangular cross section.

2. The device according to claim 1, wherein the one or more second retaining ribs each have apex edges, wherein the apex edges of the one or more second retaining ribs on the inward face of the first wall portion are offset along a direction from the proximal edge to the distal edge from the apex edges of the one or more second retaining ribs on the inward face of the second wall portion.

3. The device according to claim 1, including a distinguishing characteristic recognizable by one or more of touch, sight, and smell.

4. The device according to claim 1, wherein an outward face of the first and/or second wall portions includes a visually or tactilely perceivable characteristic.

5. The device according to claim 4, wherein the visually or tactilely perceivable characteristic is one or more alphanumeric characters and/or symbols.

6. The device according to claim 5, wherein the outward face of the first and/or second wall portions includes a visually and tactilely perceivable characteristic.

7. The device according to claim 6, wherein the visually and tactilely perceivable characteristic comprises one or more tactilely perceivable alphanumeric characters and/or symbols.

8. The device according to claim 1, wherein the first and second retaining ribs are located on a relatively distal end of the device, spaced away from the base portion, thereby defining a receiving groove at a relatively proximal end of the device adjacent to the base portion, the receiving groove being defined by the base portion and opposing portions of the inward faces of the first and second wall portions adjacent to the base portion.

9. A kit for marking a plurality of similar textile articles so as to distinguish between them, comprising:

a plurality of clip devices, each clip device comprising:

a first wall portion having proximal and distal edges and an inward face and an outward face;

a second wall portion having proximal and distal edges and an inward face and an outward face; and a base portion extending between the respective proximal edges of the first and second wall portions so as to space apart the first and second wall portions with the respective inward faces of the first and second wall portions facing each other;

wherein the first and second wall portions are resiliently flexible relative to the base portion, and are generally convergent in a direction from their proximal edges towards their spaced apart distal edges;

wherein the inward face of the first wall portion is provided with a first retaining rib having a width generally extending in a direction parallel to the base portion and a generally triangular cross section, and the inward face of the second wall portion is provided with a corresponding first retaining rib having a width generally extending in a direction parallel to the base portion and a generally triangular cross section, wherein the first retaining ribs have respective opposing apex edges generally aligned with one another;

wherein one or more second retaining ribs are located on the inward faces of the first and second wall portions respectively and distal to the first retaining ribs, the one or more second retaining ribs having a width generally extending in a direction parallel to the base portion and a generally triangular cross section;

wherein the each of the plurality of clip devices is provided with a common distinguishing feature that permits a first clip device to be distinguished from a second clip device.

10. The kit according to claim 9, wherein the distinguishing feature is one or more of a unique visual element, a unique tactile element, and a unique smell element, wherein each of the plurality of clip devices has the same kind of distinguishing feature or features.

11. The kit according to claim 10, wherein the unique visual element is one or more alphanumeric characters and/or symbols provided on an outward face of one or both of the first and second wall portions.

12. The kit according to claim 9, wherein the one or more second retaining ribs each have apex edges, wherein the apex edges of the one or more second retaining ribs on the inward face of the first wall portion are offset along a direction from the proximal edge to the distal edge from the apex edges of the one or more second retaining ribs on the inward face of the second wall portion.

13. An identification device comprising:

a first wall portion having opposing first and second ends and an inward face and an outward face;

a second wall portion having opposing first and second ends and an inward face and an outward face;

a base portion extending between and fixedly connecting the respective second ends of the first and second wall portions so as to space apart the first and second wall portions with the respective inward faces of the first and second wall portions facing each other, wherein the first and second wall portions are resiliently flexible relative to the base portion;

wherein the inward face of the first wall portion is provided with a first retaining rib having a width generally extending in a direction parallel to the base portion and a generally triangular cross section, and the inward face of the second wall portion is provided with a corresponding first retaining rib having a width generally extending in a direction parallel to the base portion and a generally triangular cross section, wherein the first retaining ribs provided on the respective inward faces of the first and second wall portions are substantially aligned;

wherein one or more second retaining ribs are located on each of the inward faces of the first and second wall portions, distal to the first retaining ribs, the one or more second retaining ribs having a width generally extending in a direction parallel to the base portion and a generally triangular cross section;

wherein at least one of the second retaining ribs extends discontinuously in a direction parallel to the base portion.

14. The device according to claim 13, wherein the one or more second retaining ribs each have apex edges, wherein the apex edges of the one or more second retaining ribs on the inward face of the first wall portion are offset along a direction from the first end to the second end from the apex edges of the one or more second retaining ribs on the inward face of the second wall portion.

15. The device according to claim 13, wherein at least one of the second retaining ribs has at least one gap along a direction of extension parallel to the base portion so as to be discontinuous.

16. The device according to claim 13, including a distinguishing characteristic recognizable by one or more of touch, sight, and smell.

17. The device according to claim 13, wherein an outward face of the first and/or second wall portions includes a visually or tactilely perceivable characteristic.

18. The device according to claim 17, wherein the visually or tactilely perceivable characteristic is one or more alphanumeric characters and/or symbols.

19. The device according to claim 18, wherein the outward face of the first and/or second wall portions includes a visually and tactilely perceivable characteristic.

20. The device according to claim 13, wherein the first and second retaining ribs are located on a relatively distal end of the device, spaced away from the base portion, thereby defining a receiving groove at a relatively proximal end of the device adjacent to the base portion, the receiving groove being defined by the base portion and opposing portions of the inward faces of the first and second wall portions adjacent to the base portion.

* * * * *